United States Patent [19]

Villanueva

[11] 4,170,334

[45] Oct. 9, 1979

[54] THEFT-DETERRENT BRACKET FOR SMOKE ALARMS

[76] Inventor: Charles V. Villanueva, 5704 W. Windsor, Chicago, Ill. 60630

[21] Appl. No.: 827,268

[22] Filed: Aug. 24, 1977

[51] Int. Cl.[2] ..... A47B 96/06

[52] U.S. Cl. ..... 248/553; 70/58; 211/4

[58] Field of Search ..... 248/203; 70/258, DIG. 57, 70/4, 18, 19, 58; 211/4, 8

[56] References Cited

U.S. PATENT DOCUMENTS

| | | | |
|---|---|---|---|
| 1,426,119 | 8/1922 | Southard | 70/18 |
| 1,828,658 | 10/1931 | Henke | 70/18 X |
| 2,529,432 | 11/1950 | Tenner | 70/19 |
| 3,081,056 | 3/1963 | Young et al. | 248/203 |
| 3,945,227 | 3/1976 | Reiland | 70/58 |
| 3,999,409 | 12/1976 | Bell | 70/58 |

*Primary Examiner*—J. Franklin Foss

*Attorney, Agent, or Firm*—Eugene F. Friedman

[57] ABSTRACT

A bracket for deterring the theft of smoke alarms attached to the surface of a room, such as the ceiling. The bracket includes two rigid metal strips coupled together by a hinge. One of the strips attaches to the wall behind the smoke alarm. Preferably, the screws holding the smoke alarm to the wall pass through holes in this part of the bracket and hold it between the wall and the alarm. After the attachment of the first strip to the wall, the second part of the bracket may then swing over the smoke alarm and connect up to the first with a lock. The lock, typically actuated by a key, deters or prevents the unauthorized separation of the bracket's parts. Hence, it limits access into the alarm itself, required to unfasten the screws holding it to the wall. Typically, the cover of the smoke alarm has two portions engaging each other, with one fitting inside the other. The bracket prevents the two halves of the cover from disengaging to allow access to the screws on the inside.

11 Claims, 6 Drawing Figures

Fig 1
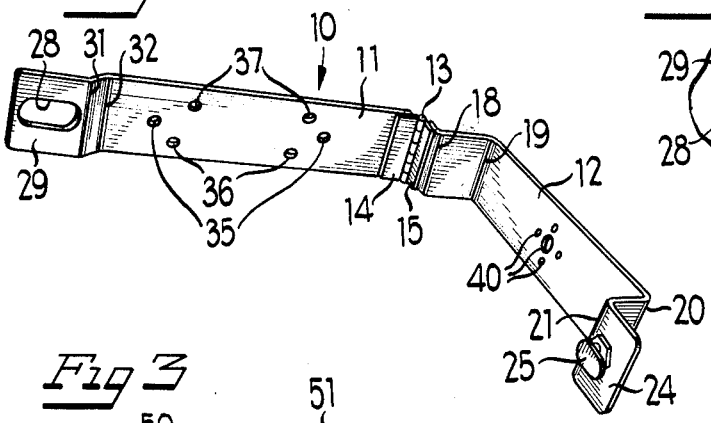
Fig 2
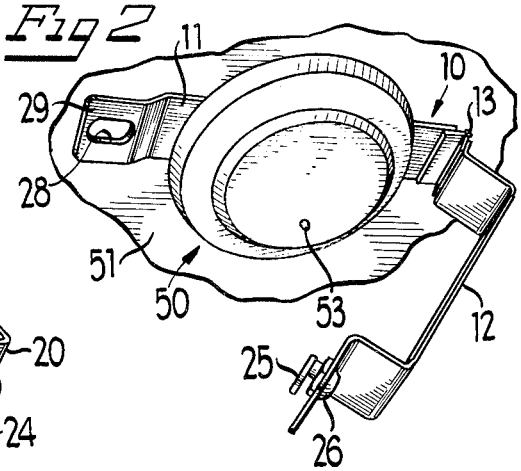
Fig 3
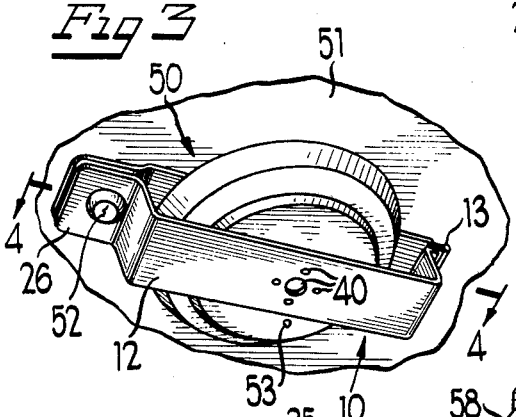
Fig 6
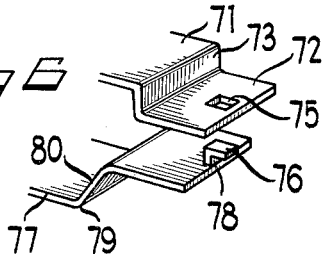
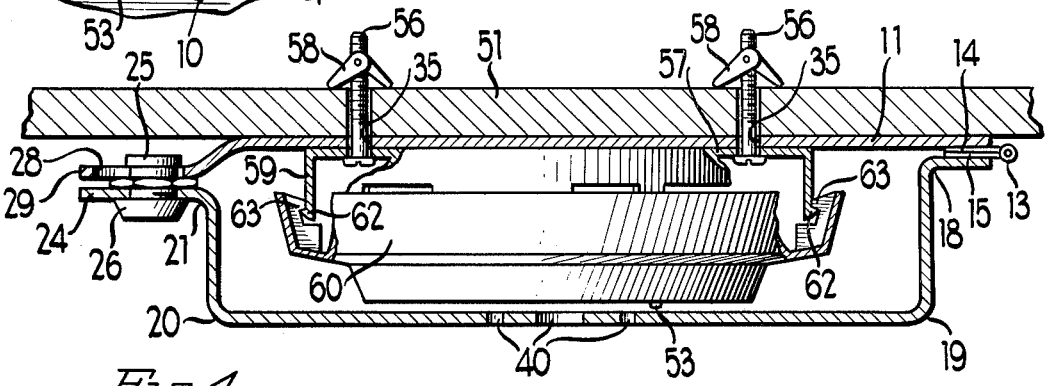
Fig 4
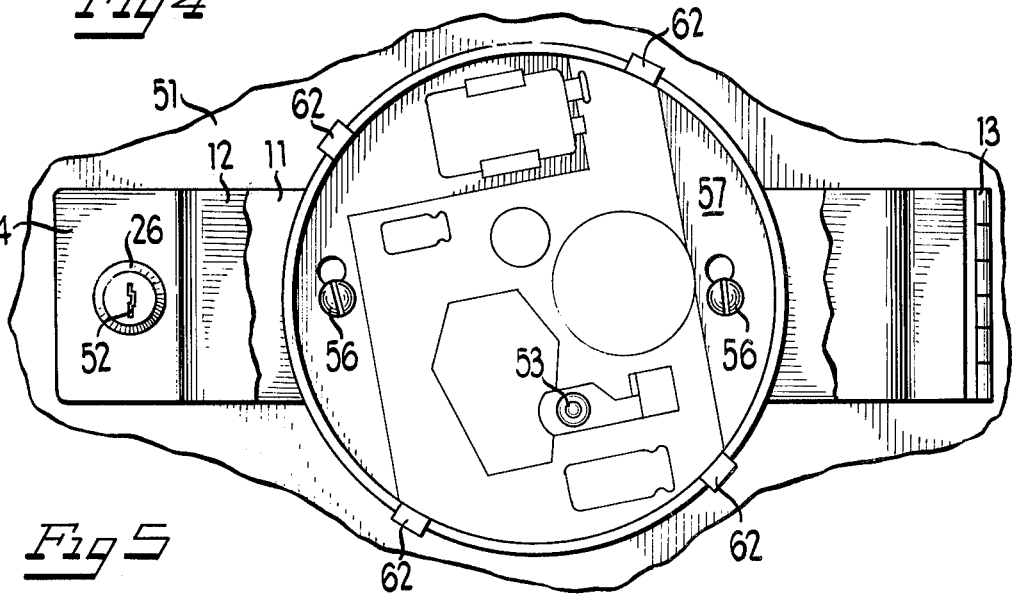
Fig 5

THEFT-DETERRENT BRACKET FOR SMOKE ALARMS

BACKGROUND

Fire often and tragically strikes people's homes or lodgings while they sleep or remain preoccupied with other activities. Lacking forewarning of the impending danger, they do not take advantage of the fleeting opportunity to escape the premises and protect themselves. The too frequent loss of life can then occur.

Sadly, the people who perish in fires very frequently could have escaped had they received warning when the fire first started, or at some early point in its progression. Often, people die in their sleep from the fumes generated by the fire without ever awakening to the danger.

The advent of smoke alarms and smoke detectors has the purpose of giving people this very warning. Properly maintained, they have proven themselves invaluable in limiting and avoiding the loss of life in fires. With an early warning, the people in the affected premises have an opportunity to escape without personal injury or death. Moreover, the warning also allows them to summon the fire department to limit the loss of property in the fire.

The tremendous benefits provided by the smoke alarms has induced owners of apartment houses to install them in public areas for the tenants' protection. Governments have even begun to require them for such buildings. The City of Chicago, for example, has recently passed an ordinance to this effect.

The components within the alarm which allow it to operate properly represent valuable items. The alarms themselves are not inexpensive. The foreseeable result of these factors often finds the alarms missing from their locations where initially installed. Consequently, the owners must either expend further funds to purchase new alarms, or the protection initially provided simply disappears. Moreover, no owner, no matter how solicitous towards his tenants, can afford to repeatedly replace stolen alarms.

To exacerbate this problem, the alarms generally have delicate covers. Moreover, the covers readily come apart to allow access to the components inside. These factors result from the necessity of minimizing the expense of the devices for general commercial use. Furthermore, the covers must allow the ambient atmosphere to readily pass into the alarm's interior so that it may detect any smoke in the air. Furthermore, the alarm must permit facile entrance to its interior in order to replace batteries or other components. However, these factors also permit immediate access to the screws holding the alarm to the ceiling or other room surface. As a result, an individual generally has little difficulty in removing the alarm and taking it with him.

SUMMARY

Accordingly, some device becomes necessary to prevent the unauthorized removal of a smoke alarm from the surface to which attached. The device, however, should not interfere with the alarm's normal operation. Moreover, it should permit relatively unencumbered access to the alarm's interior when required for maintenance.

Typically, the smoke alarm has a cover and a fastening device engageable with the room surface to attach the alarm to the surface. A bracket to deter the theft of the alarm should include a first rigid part with an affixing means to hold it adjacent to the same room surface. The bracket should also include a second rigid part. Coupled to these two parts, a holding means retains them in proximity to each other. The rigid parts may take the form of properly bent strips of metal that, when attached to each other, barely accommodate the smoke alarm between them. The holding means may take the form of a hinge, which allows the two parts to move relative to each other while keeping them near each other.

Lastly, the bracket should include some form of locking device coupled to at least one of the first or second parts mentioned above. The lock, of course, has two configurations. In the first, it retains the first and second parts in contact with each other. The locking device also incorporates the usual mechanism which limits the unauthorized movement from the first, or locking, to the second, or open, configuration.

The first and second parts, when held together by the lock, include a coupling which maintains a fixed orientation between them and the alarm's cover. The first and second parts, when retained together and with a fixed orientation relative to the cover, prevent the disengagement of the fastening device which holds the alarm's cover to the room surface. Consequently, the bracket deters the removal of the cover and, thus, the alarm itself from their location.

BRIEF DESCRIPTION OF THE FIGURES

FIG. 1 shows a smoke alarm theft-deterrent bracket with its two metal strips hinged together and open.

FIG. 2 depicts the same bracket of FIG. 1 with the two strips remaining open, but with a smoke alarm located adjacent to one of the strips.

FIG. 3 illustrates the theft-deterrent bracket fitting snugly around a smoke alarm.

FIG. 4 gives a cross-sectional view along the line 4—4 of the bracket and alarm of FIG. 3 showing the attachment of both to the ceiling.

FIG. 5 has a partially broken-away view of the combination of smoke alarm and theft-deterrent bracket portraying some of the alarm's inner components, as well as the alarm's screws.

FIG. 6 shows a tab and receptacle mechanism located at the ends of the first and second parts for joining them together.

DETAILED DESCRIPTION

In FIG. 1, the theft-deterrent bracket, shown generally at 10, includes the two metal strips 11 and 12. The two sides 14 and 15 of the hinge 13 have an attachment, such as welding, to the two strips 11 and 12 to retain them in proximity to each other.

The second metal part 12 includes the bends 18, 19, 20, and 21 which give it basically a U-shape and allow it to fit about the smoke alarm. The end 24 of the second metal strip 12 includes the tab 25 forming part of the locking mechanism 26. The tab 25 fits inside of the opening 28 in the end 29 of the first metal strip 11. The slight bends 31 and 32 in the first strip 11 slightly remove the end 29 from the wall in order to leave room for the tab 25.

The pairs of holes 35, 36, and 37 pass through the first strip 11. These holes allow the pairs of screws, which hold the smoke alarm to the wall, to pass through the first strip 11, hold it to the wall with the alarm, and orient the bracket 10 relative to the alarm. The several pairs 35–37 of holes permit the same bracket to accommodate different alarms. The holes 40 pass through the second strip 12 to allow any smoke in the environment to enter the alarm.

FIG. 2 shows a smoke alarm 50 and the bracket 10 attached to the wall or ceiling 51. The first and second strips 11 and 12 still can pivot about the hinge 13 relative to each other. This represents the appearance of the components after screws passing through the alarm 50 and the first strip 11 have initially attached them to the wall.

To complete the attachment of the bracket 10, the second strip 12 swings around the smoke alarm 50 until the tab 25 enters the opening 28 on the first strip 11. A key, inserted into the opening 52 of the lock 26, turns the tab 25 until its longer dimension lies perpendicular to the longer dimension of the opening 28. This crossing of the longer dimensions of the tab 25 relative to the opening 28 prevents the opening of the bracket 10. Removing the key from the lock 26 deters unauthorized individuals from changing the position of the metal tab 25 to open the bracket 10.

The appearance of the bracket locked around the alarm 50 and attached to the wall 51 appears in FIG. 3. As shown there, the openings 40 in the second strip 12 still readily permit smoke in the environment to reach the detector. Moreover, the strip 12 leaves the combination button-light 53 of the alarm 50 uncovered. This button-light 53 allows for the testing of the circuit inside the detector 50 and, of course, must remain free, as shown, for occasional use.

The attachment of the alarm 50 and the bracket 10 to the wall 51 appears more clearly in FIG. 4. The screws 56 pass through the bottom 57 of the alarm 50, the openings 35, in this instance, of the first metal strip 11, and through the wall or ceiling 51. The toggle anchors 58 then securely fasten the components held by the screws 56 to the ceiling 51.

Thus, the screws 56 hold the inner half 59 of the cover of the alarm 50 as well as the metal strip 11 to the wall or ceiling. The second or outer half 50 of the alarm 50 may then snap onto the first half 59 to completely enclose the inner components of the alarm 50. As seen diagrammatically in FIG. 5, the various electrical components of the alarm 50 attach to the bottom 57 of the inner cover portion 59.

The catches 62, as shown both in FIGS. 5 and 4, form part of the inner half 59 of the alarm's cover and have outwardly pointing ridges. These engage the inwardly pointing latches 63 on the second half 60 of the alarm's cover, as in FIG. 4, to hold the two halves 59 and 60 together.

The bracket 10 need not totally prevent the disengagement of the catches 62 on the first half 59 from the latches 63 on the second half 60 of the alarm's cover. The bracket 10 must only prevent the second half 60 of the cover from moving sufficiently far away from the first half 59 that the two halves may completely separate from each other.

Thus, although the fragile catches 62 and latches 63 may disengage from each other, the bracket 10 retains the cover's second half 60 in close proximity to the first half 59. In the first instance, this prevents the cover's second half 60 moving directly away from the wall to which the first half attaches. Consequently, the first half 59 of the cover remains telescoped, at least to some extent, within the cover's second half 60. As a result, the latter portion 60 also cannot move laterally to disengage from the first portion 59 attached to the ceiling. Accordingly, the bracket 10 uses the two portions of the cover to augment the functioning of the catches 62 and the latches 63 to keep the two halves together.

The potential thief now has the entire two halves of the alarm remaining engaged with each other. He cannot separate them by pulling one directly away from the other. Nor can he disengage the catches 62 from the latches 63 by trying to move the outer portion 60 of the cover laterally away from the inner portion 59.

The two portions 59 and 60 of the alarm's cover, when engaged with each other, as an entity provide an enclosure for the screws 56. Unable to separate the two cover portions 59 and 60 from each other, the potential thief cannot undo and remove the screws 56 which hold the alarm to the ceiling 51. Thus he cannot remove the unit as a whole. Moreover, the alarm's cover also protects the various components on the inside of the alarm, preventing their theft individually.

As discussed above, the hinge 13 holds the two strips 11 and 12 in proximity to each other. However, the space available for the installation of the alarm 50 may not suffice to allow the strip 12 to swing out from the strip 11 as shown in FIGS. 1 and 2.

FIG. 6 presents a different type of holding device for retaining the two strips in proximity to each other. There, the first strip 71 has the end 72 removed slightly from the wall or ceiling by the bends 73. The end 72 also has the opening 75 into which the tab 76 of the second strip 77 may fit. In fact, the tab 76 enters the opening 75 and sits behind the end 72 of the first strip 71. The small vertical section 78 of the second strip 77 actually fits within the opening 75. The bends 79 and 80 then provide sufficient distance between the two strips 71 and 77 to allow the smoke alarm to fit between them.

The other ends of the strips 71 and 77 do not appear in FIG. 6. However, they would look very similar to those of the strips 11 and 12 of FIG. 1. Thus, for example, the first strip 71 would have an opening such as 28 on the end 29 of the first strip 11. The second strip 77 would have a locking mechanism similar to the lock 26 with its tab 25 that engages the end 29 of the first strip 11. Thus, the tab 76, passing through the opening 75, would hold one end of the strips 71 and 77 together. Simultaneously, a lock would hold the other ends together, and also prevent the removal of the tab 76 from the opening 75.

Accordingly, what is claimed is:

1. A theft-deterrent bracket for a smoke alarm having a cover and a fastening device engageable with a room surface for attaching said alarm to said surface, said bracket comprising:

(A) a first rigid part including affixing means for holding said first part adjacent to said room surface;

(B) a second rigid part;

(C) holding means permanently coupled to said first and said second parts for retaining said first and second parts in proximity to each other; and p1 (D) locking means permanently affixed to at least one of said first and second parts and having first and second configurations, for, in the first and second configurations, fixedly retaining said first and second parts in contact with each other, said locking means including means for limiting its unauthorized movement from said first to said second configurations, said first and second parts, when retained in contact with each other by said locking means and with said first part held adjacent to said room surface by said affixing means, including (a) coupling means adapted to maintain said first and second parts in a fixed orientation relative to said cover of said alarm and, when thus maintained in said fixed orientation relative to said cover by said coupling means, adapted to prevent disengagement of said fastening device to allow the removal of said cover from said room surface and (b) protecting means for substantially preventing access to said locking means.

2. The bracket of claim 1 wherein said first and second parts, when fixedly retained in contact with each other by said locking means and when maintained in a fixed orientation relative to said cover by said coupling means, are adapted to maintain said cover in the form of a nonopenable enclosed case enclosing said fastening device.

3. The bracket of claim 2 wherein said first and second parts have elongated shapes and a composition of metal and, when retained in contact with each other by said locking means, have a shape to define a space therebetween sufficiently large to barely allow said alarm to fit therein.

4. The bracket of claim 3 wherein said locking means includes a cam lock permanently affixed to said second part.

5. The bracket of claim 3 wherein said holding means includes a hinge attached to both said first and second parts.

6. A smoke alarm and theft-deterrent bracket combination comprising (1) a smoke alarm having a cover with two portions engageable with each other and a fastening device engageable with a room surface and having screws extending from the inside of said cover to the outside of said cover for attaching said alarm to said surface and (2) a bracket comprising:

(A) a first rigid part including affixing means for holding said first part adjacent to said room surface;

(B) a second rigid part;

(C) holding means permanently coupled to said first and second parts for retaining said first and second parts in proximity to each other; and (D) locking means permanently affixed to at least one of said first and second configurations for, in the first of said configurations, fixedly retaining said first and second parts in contact with each other, said locking means including means for limiting its unauthorized movement from said first to said second configurations, said first and second parts, when retained in contact with each other by said locking means, including coupling means for maintaining said first and second parts in a fixed orientation relative to said cover of said alarm and, when thus maintained in said first orientation relative to said cover by said coupling means, preventing disengagement of said fastening device to allow the removal of said cover from said room surface and substantially preventing access to said locking means, and said first and second parts, when fixedly retained in contact with each other by said locking means and when maintained by said coupling means in a fixed orientation relative to said cover, preventing the disengagement of said first and second portions from each other.

7. The combination of claim 6 wherein, when one of said portions of said cover fits inside the other of said portions and said portions are engaged with each other, said first and second parts, when fixedly retained in contact with each other by said locking means and maintained by said coupling means in a fixed orientation relative to said cover, prevent the removal of said one portion from the inside of said other portion.

8. The combination of claim 7 wherein said first part and said second part, when fixedly retained in contact with each other by said locking means and when maintained by said coupling means in a fixed orientation relative to said cover, completely surround said alarm in at least one direction.

9. The combination of claim 8 wherein said coupling means includes holes passing through said first part and screws passing through said holes and through openings in at least one portion of said cover.

10. The combination of claim 9 wherein said screws of said coupling means are said screws of said fastening device, and said affixing means includes said coupling means with said screws passing through openings in said cover, said holes in said first part, and into said room surface, to attach said cover and said first part to said wall and maintain said first part and said cover in a fixed orientation relative to each other.

11. The combination of claim 10 wherein said holding means includes a hinge attached to both said first and said second parts.

* * * * *